US008060998B2

(12) United States Patent
Rey et al.

(10) Patent No.: US 8,060,998 B2
(45) Date of Patent: Nov. 22, 2011

(54) HANDLING METHOD AND DEVICE FOR SIMULTANEOUS PROCESSING OF TEXTILE PIECES

(75) Inventors: Yannick Rey, Montcenis (FR); Michel Calonne, Auxy (FR); Marc Genevoy, Fragny (FR)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 1465 days.

(21) Appl. No.: 10/540,901

(22) PCT Filed: Dec. 29, 2003

(86) PCT No.: PCT/FR03/03932

§ 371 (c)(1),
(2), (4) Date: Sep. 18, 2006

(87) PCT Pub. No.: WO2004/060092

PCT Pub. Date: Jul. 22, 2004

(65) Prior Publication Data

US 2007/0033778 A1 Feb. 15, 2007

(30) Foreign Application Priority Data

Dec. 30, 2002 (FR) ..... 02 16869

(51) Int. Cl.
*D06H 7/00* (2006.01)

(52) U.S. Cl. ..... 28/170; 28/153

(58) Field of Classification Search ..... 28/165, 28/170, 171, 100, 153, 143; 271/11, 14, 271/90, 91, 93–95, 103, 104, 105, 106; 414/797, 414/627, 801, 793; 112/470.14, 470.15, 112/470.18, 148, DIG. 2, 122, 129; 294/64.1; 83/13, 14, 23, 78, 404, 452, 465
See application file for complete search history.

(56) References Cited

U.S. PATENT DOCUMENTS

| | | | | | |
|---|---|---|---|---|---|
| 1,996,385 | A | * | 4/1935 | Owen | 294/86.4 |
| 3,036,537 | A | | 5/1962 | Breier | |
| 3,117,815 | A | * | 1/1964 | Creskoff | 294/64.1 |
| 3,289,860 | A | * | 12/1966 | Dean | 414/796 |
| 3,531,107 | A | * | 9/1970 | Rovin et al. | 271/236 |
| 3,539,216 | A | * | 11/1970 | Forcier | 294/64.3 |
| 3,588,091 | A | * | 6/1971 | Stone | 271/19 |
| 3,740,029 | A | * | 6/1973 | Bays | 271/11 |
| 3,788,505 | A | * | 1/1974 | Kirsch | 414/800 |
| 3,879,031 | A | * | 4/1975 | Melehan | 271/11 |
| 4,498,404 | A | | 2/1985 | Sadeh | |
| 4,756,261 | A | | 7/1988 | Gershoni | |

(Continued)

FOREIGN PATENT DOCUMENTS

DE 3915975 11/1990

(Continued)

*Primary Examiner* — Amy Vanatta
(74) *Attorney, Agent, or Firm* — Ohlandt, Greeley, Ruggiero & Perle, LLP

(57) ABSTRACT

A device for processing a supple porous textile piece having at least one first surface and one second surface adjacent to the first surface, the process being carried out on the second surface and not on the first surface The device includes a departure area and an arrival area for placing the textile piece. The departure area is equipped with a non-porous mobile mask with a shape corresponding to the first surface. The device also includes a processing area equipped with processing means, a pick-up head with a suction plate having a shape corresponding to that of the mask. The pick-up head being moveable among the departure area, the processing area, and the arrival area.

10 Claims, 2 Drawing Sheets

U.S. PATENT DOCUMENTS 4,881,770 A * 11/1989 Marzinotto et al. ..... 294/64.1
4,896,618 A 1/1990 Blake et al.
4,960,361 A * 10/1990 Melzer ..... 414/801
5,040,475 A 8/1991 Fournier et al.
5,165,355 A 11/1992 Fournier et al.
5,238,237 A 8/1993 Morris et al.
5,272,994 A * 12/1993 Scholl et al. ..... 112/470.18
5,379,708 A * 1/1995 Moll et al. ..... 112/470.17
5,535,997 A 7/1996 Croyle et al.
5,603,274 A * 2/1997 Conley et al. ..... 112/470.14
5,848,785 A * 12/1998 Hardwick et al. ..... 271/11
6,029,593 A * 2/2000 Migliorini ..... 112/475.12

FOREIGN PATENT DOCUMENTS

FR 2820290 8/2002
WO WO 84/02451 7/1984

* cited by examiner

HANDLING METHOD AND DEVICE FOR SIMULTANEOUS PROCESSING OF TEXTILE PIECES

CROSS-REFERENCE TO RELATED APPLICATIONS

This application claims the benefit under 35 U.S.C. §365 of International Application Serial No. FR2003/03932, filed Dec. 29, 2003 and the benefit under 35 U.S.C. §119 of French Application Serial No. 02/16869, filed Dec. 30, 2002, the entire contents of each of which are incorporated by reference herein.

BACKGROUND OF THE INVENTION

1. Field of the Invention

The present invention relates to a method and a device for the handling and processing of textile pieces, in particular but not exclusively, textile pieces of the type used for lingerie, for example for the production of brassieres.

2. Description of Related Art

Since textile fabric is usually supple, especially when delicate and very porous textiles such as those used for lingerie are concerned, it is very complicated to automate the manufacturing processes: it is very difficult for a machine to be able to pick up and arrange textile pieces with precision and reproducibility directly in front of the processing stations, such as those for cutting out or sewing, and to maintain them in position during the processing.

Nonetheless, various methods and devices have been proposed for handling textile pieces: usually the handling lacks precision and is limited to moving and picking up, etc.; in some cases, where the handling provides the possibility of completely automated processing for textile pieces, this concerns relatively small sized pieces, in fairly stiff and not very porous fabric.

The Levi Strauss document, U.S. Pat. No. 5,535,997, describes a procedure for de-stacking pieces of denim fabric from a pile using suction discs that can lift up one end of the top piece on the pile and then carry it onto a conveyor belt. Evidently, such a method would be impossible with the very lightweight and very porous fabrics used for lingerie.

The document, U.S. Pat. No. 5,238,237 describes the maintenance of porous textile pieces on a suction table and then picking them up using a needle device or a pneumatic device with a suction force greater than that of the suction table.

Sara Lee documents U.S. Pat. Nos. 5,165,355 and 5,040,475 describe a complex handling device for textile pieces intended for manufacturing tights, using a pneumatic system to pick up one piece from a pile of pieces and to carry it away for further processing.

The Pacific Dunlop document U.S. Pat. No. 4,896,618 also describes the use of suction means to pick up elastic strips for textile pieces intended for manufacturing panties, in order to place the pieces in various pleating and stretching devices that then carry the piece to the sewing stations. Such a method is very specific and is restricted to a single type of garment only, since it requires the presence of elastic strips that can be picked up by suction and furthermore cannot easily be adapted to different shapes and sizes.

Document U.S. Pat. No. 4,756,261 is of greater interest, providing information about setting the textile pieces at a precise orientation, picking them up and carrying them using a robot arm, still maintaining this orientation, until they reach a workstation where they are processed, for example sewn. The robot arm is equipped with a pick-up head with a suction plate that applies a very precise vacuum action (approximately 0.2 atmosphere) through specially adapted holes, to pick up and move the piece. However, as in the case of document U.S. Pat. No. 5,535,997 described hereabove, this is possible because it involves lifting and carrying pieces of "denim" fabric intended for shirt or trouser pockets. It would be impossible to use such a device for very porous textiles such as those used for lingerie.

The same observations are applicable to document U.S. Pat. No. 4,498,404, describing a perforated table connected to negative or positive pressure means, on which textile pieces can be placed, while a handling arm equipped with a suction plate picks up another piece, places it on top of the first piece and then carries the two superposed pieces to a sewing station.

Thus, all the above documents seem to demonstrate that textile piece handling using suction plates is possible as long as the textile is not very porous, as is the case with "denim" cloth, but not for the case of lingerie, manufactured with very lightweight, very supple fabrics, and sometimes lace.

For these fabrics, another research approach has been tried, as shown for example in document FR 2820290, describing how to cut out a piece in very supple fabric, using a temporary stiffening method by attaching it to a support sheet, for example in silicone coated paper, using hot calendering. Other temporary stiffening methods for textile pieces have also been proposed, for example, fixation by passing the fabric through a bath of stiffening product, or freezing, etc. In all these cases, this involves the addition of a supplementary stage that adds to the cost, and which is then doubled because of a stage needed for removing the temporary stiffening. Moreover, these stiffening methods are not without harmful consequences for very delicate fabrics like lace, which may be used for lingerie, and therefore these methods are not really suited to this field.

Therefore, since no really satisfactory methods have been discovered, the manufacture of certain lightweight textile articles such as lingerie remains an essentially manual operation, and is consequently expensive.

BRIEF SUMMARY OF THE INVENTION

The aim of the present invention is to solve this problem by proposing an automated device for handling and processing textile pieces, particularly well adapted to the type of textiles used for lingerie.

The invention achieves this aim through a method for processing a supple porous textile piece comprising at least one first surface and a second surface adjacent to the first surface, the processing being carried out on the second surface and not on the first surface, the method being of the type comprising the following stages:

- the textile piece is placed on a departure area;
- a mobile pick-up head equipped with a suction plate is brought above the textile piece;
- the pick-up head carries the piece to a processing area equipped with processing means;
- the processing is applied to the second surface, the piece still being maintained by the pick-up head, the relative movements between the processing means and the piece, necessary for processing the second surface, being obtained by changing the position of the head and/or the position of the processing means;
- The pick-up head removes the piece from the processing area, takes it to an arrival area and releases it;
- the textile piece is removed from the arrival area, the method being characterised in that:

a non porous mobile mask with a shape corresponding to the first surface is already set in place on the departure area;

a mobile pick-up head with a suction plate of a shape corresponding to that of the mask is positioned above the textile piece;

the pick-up head takes the textile piece and the mask to the processing area equipped with said processing means, the processing is applied to the second surface, the piece and the mask still being held by the pick-up head.

the pick-up head takes the textile piece and the mask away from the processing area, carries them to the arrival area and releases them there.

Thus, thanks to the mobile mask, it is possible to pick up textile pieces in very porous fabric, even lace. The mask makes maintenance of the first surface possible in co-operation with the pick-up head suction action. The mask does not hinder processing, for example cutting out or sewing, on the second surface adjacent to the first surface. By corresponding shape between the mask and the first surface and between the mask and the suction plate it is understood that the shape of the first object is totally included within the shape of the second, or identical to the latter; thus, on the one hand, the mask does not protrude beyond the perimeter of the first surface and does not hinder the processing to be applied in the second surface; and on the other hand, the suction plate (or at least its active suction part) is applied on the textile piece within the perimeter of the mask, and for this reason can lift and carry the piece by raising the mask at the same time, without any suction outside the mask perimeter "in empty space".

The mask provides the advantage of maximising fabric adherence, whatsoever its porosity, of preventing any suction effect on work surfaces, and of avoiding soiling of the processed product.

Advantageously, the first surface is an internal surface and the second surface is a perimetric surface surrounding the first surface at least partially. It is possible, and advantageous for certain pieces, to envisage that the first surface be composed of several separated parts, to be picked up by a suction plate also constituted of separated parts.

Advantageously, the arrival area is the same as the departure area, or at least an area that can also be used as another departure area such that the masks released after a previous handling operation can be used for a following procedure in a later cycle.

The present invention also concerns, as mentioned hereabove, a device adapted for implementation of the method according to the invention, that is, a device used to process a supple porous textile piece comprising at least one first surface and one second surface adjacent to the first surface, the processing being carried out on the second surface and not on the first surface, the device being of the type comprising:

a departure area and an arrival area for laying out the textile piece, a processing area equipped with processing means, a pick-up head with a suction plate that can move between the departure area, the processing area and the arrival area, the device being characterised in that:

the departure area is equipped with a non-porous mobile mask with a shape corresponding to the first surface, the mobile pick-up head has a suction plate with a shape corresponding to said mask.

Advantageously the departure area and/or the arrival area has an upper surface formed by two half-plates separated by a space, enabling positioning of the textile piece with a compensating loop for possible dimensional variations of the textile piece.

Advantageously the departure area and/or the arrival area is composed of at least one pull-out tray, and preferably two, to allow an operator or a machine to prepare the textile pieces outside the actual processing area, which could advantageously be closed.

Advantageously, the pick-up head comprises a suction plate composed of two separated parts.

Advantageously the pick-up head is carried by a multi-axis robot capable of performing all the movements necessary for handling and processing the textile piece.

The device according to the present invention is characterised by its great flexibility and adaptability to any change in the textile piece being processed. The pull-out tray and the head can easily be modified to make them specific to the type of piece to be processed.

BRIEF DESCRIPTION OF THE SEVERAL VIEWS OF THE DRAWINGS

Other advantages and characteristics of the present invention will become clearer by reading the following description with reference to the attached drawings in which.

DETAILED DESCRIPTION OF THE INVENTION

Figure 1:
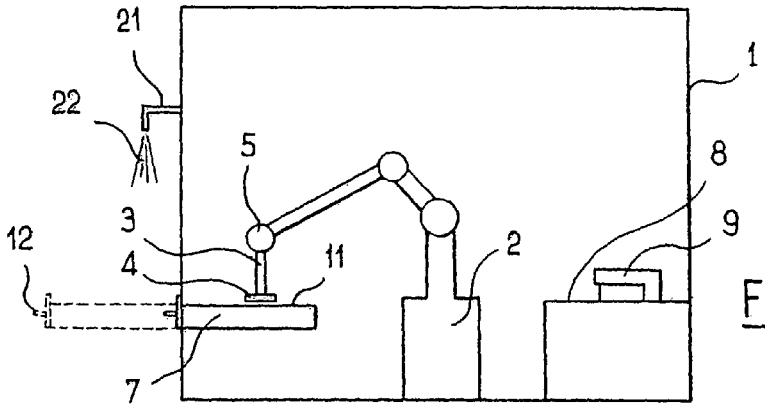
FIG. 1 is a diagram showing a side view of an installation using the device according to the invention.
Figure 2:
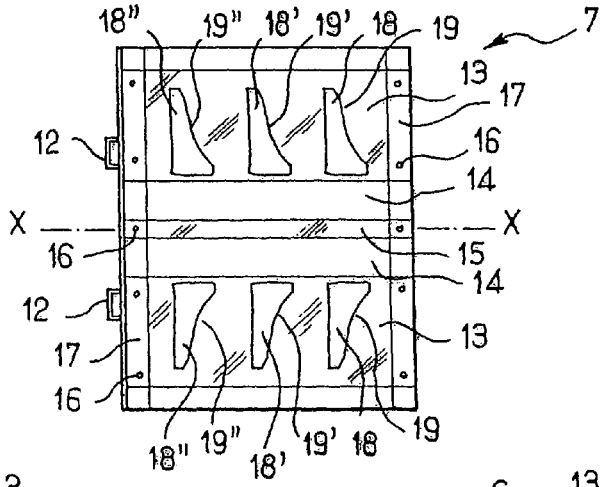
FIG. 2 is a bird's eye view of a departure area pull-out tray of the device shown in FIG. 1.
Figure 3:
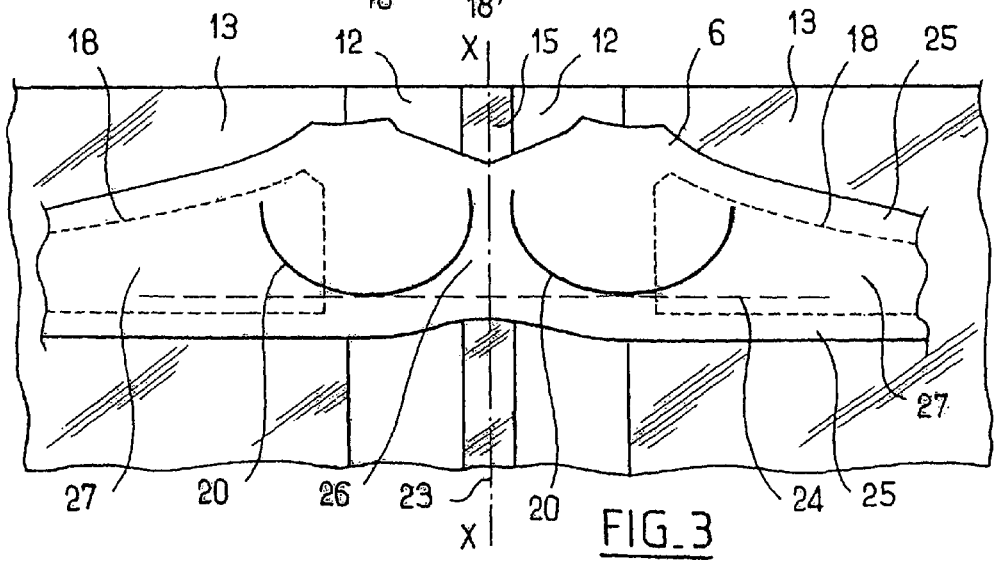
FIG. 3 is a detailed view showing the position of a brassiere preform placed on the pull-out tray shown in FIG. 2
Figure 4:
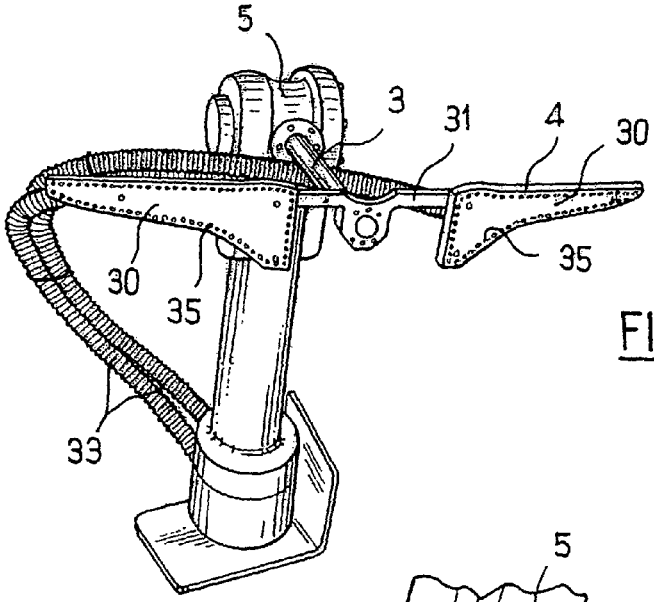
FIG. 4 is a view in perspective showing the suction plate at the end of the handling robot arm
Figure 5:
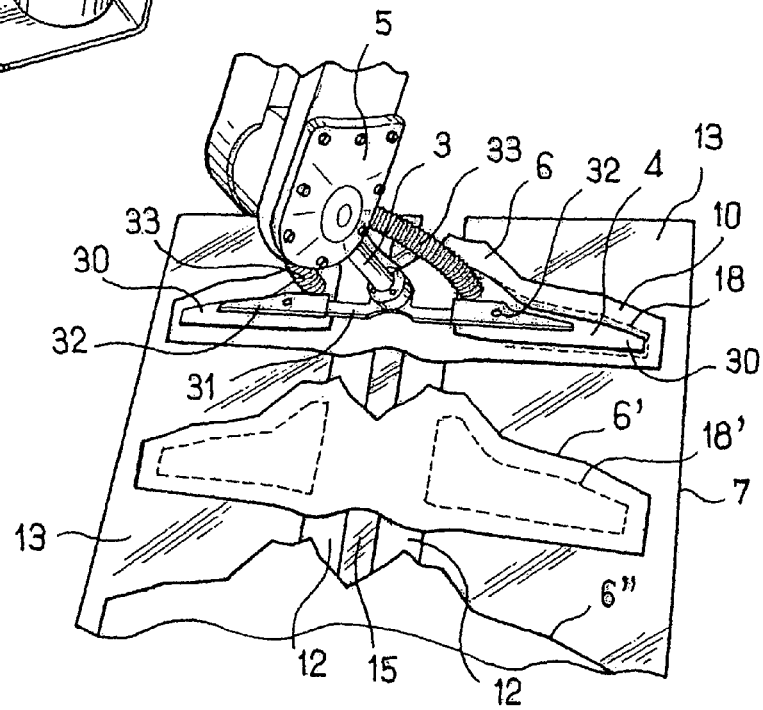
FIG. 5 is a view in perspective from above of the suction plate positioned to pick up a preform on the pull-out tray in FIG. 2.

FIG. 1 shows a schematic diagram of the device according to the invention comprising, inside a cabin that may be closed 1, a handling robot 2 with 6 programmable axes, and where the end arm 3, articulated on joint 5, carries the pick-up head 4. The head 4 moves to find and pick up a brassiere preform 6 laid out on a pull-out tray 7, carries it to a work bench 8 for processing by processing means 9, and then carries it back to the same pull-out tray 7 after processing. The work benches can be several in number with multiple workstations for successive processing where the head 4 will bring the brassiere preform 6. These are, in particular, cutting-out stations, for example using ultrasound disks able to cut out the perimeter 10 of the preform 6 exactly to the required shape.

Advantageously, to provide mask loading time, there should be at least two pull-out trays 7, side-by-side, or superposed, so that an operator can load one tray while the other is being unloaded and reloaded by the robot. Each pull-out tray 7 can assume a closed position as shown by the solid lines in FIG. 1, in which its upper surface 11, constituting both the textile piece departure area and the arrival area, is entirely situated inside the cabin 1, and is accessible to robot 2, plus an open position shown by the dotted lines in FIG. 1 in which its surface 11 is outside the cabin 1, and is accessible to an operator or an external robot for loading/unloading. The pull-out tray 7 is mounted on a slide system and can be pulled out using handles 12. Its upper surface 11 is composed of two main half-trays 13, symmetrical in relation to the median axis XX of the tray 7 and separated by a space 12, this space being occupied in the middle by a central support cross bar 15. The exact position of the half-trays 13, and the central cross-bar can be modified on the tray according to the pieces to be processed, and fixed using means such as screws 16, on an upper frame 17 of the pull-out tray 7.

The pull-out tray can receive several preforms at the same time, for example 6, 6', 6", whose lay-out is marked on the half-trays 13, for example by a slight indentation formed by very slight hollowing 19, 19', 19". Each indentation permits the precision positioning of the mask 18, 18', 18", of the same shape created in a relatively semi-rigid and non-porous material, such as cardboard or plastic, so that it is in close contact with the same surface as the rest of the half-trays 13. These masks 18, 18', 18", are simply placed without any form of fixation in their corresponding indentation. The term semi-rigid refers above all to the fact that mask 18 must possess a certain consistency so that it can be easily handled, while still maintaining its flat aspect to allow it to be easily slid onto the work surface 8. Rigidity is not essential for lifting the preform 6 picked up sandwiched between the mask 18 and the suction plate. On the contrary, certain flexibility is useful to ensure that the mask adapts perfectly to any parts in relief on the preform 6, such as inserted boning.

When a brassiere preform 6 is placed by the operator above its position on the tray 7, it covers the two masks 18, provided in this position. At this stage, the preform 6 is composed of, for example, a flat textile piece previously inserted with boning 20 that will be used as reference guides for later processing, allowing it to be placed in an exact pre-determined orientation, and the processing appropriate to this particular orientation. To obtain this, the front of the cabin is equipped with projection means 21, for laser beams 22 that project luminous lines on the upper surface of the open pull-out tray 7, for example the perpendicular lines 23 and 24. Line 23, coinciding with the axis XX of the tray and the perpendicular line 24, act as guide for the operator so as to place the preform in a pre-determined position relative to the boning 20: the boning is placed symmetrically compared to line 23 and tangential to line 24. In this position, the preform 6 covers the masks 18 with its parts 27 (constituting the first, non-processed surface of the textile piece) but on the one hand it protrudes along the edge 25 (constituting the second previously processed surface of the textile piece) while on the other hand it possesses a whole central part 26 that is not positioned on a mask. All these parts 25 and 26, or only the marginal part 25, can be processed later, for example, with cutting out or sewing operations.

Figure 6:
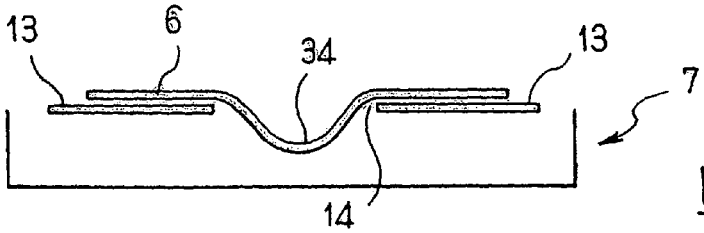
FIG. 6 is a simplified diagram showing a cross-section of a preform positioned so as to form a loop on a pull-out tray.

Depending on the types of pieces to be processed, this central part 26 can be left flat as shown, or can be left to drop partially in a curve in the space 14 provided between the two half-plates 13 and the central bar 15. The central bar 15 can also be removed, as shown in the illustration in FIG. 6 where piece 6 is shown supported by the half-plates 13 only, creating a loop 34 in the intermediate space 14. This loop 34 is advantageous because of the fact that it deals with the size variations of the preform 6 that may be caused by different reasons during preform manufacturing and initial processing, particularly heat processing (thermo-adhesive for example) resulting in size and shape variations that are not always easy to control; thanks to the loop 34, the side parts of the preform 6 are placed in a carefully marked part of the tray 7, and will undergo the exact pre-selected processing once they have been taken up by the pick-up head 4.

The robot pick-up head 4 comprises two symmetrical suction plates 30 carried by a central arm 31 attached to the end of the arm 3 of the robot so that the exact intermediate spacing can be adjusted using adjustable fixation systems 32. The shape of the plates 30 is practically the same as that of the masks 18, in this case close to an elongated triangle. The active part of the suction plates 30, defined by a line of suction holes 32 around the perimeter, forms a shape that follows the shape of the masks 18, 18', 18". The suction holes 32, are connected to a vacuum system not shown in the illustrations, through flexible hosing 33 following the movements of the robot arm 3.

The device operates in the following way.

During masking time, while the robot 2 is dealing with a previous batch of preforms 6, an operator or a machine places three preforms 6, 6', 6", on an open tray 7 with precision, using the laser guide lines 23 and 24, above masks 18, 18', 18", arranged with precision in their indentations 19, 19', 19". Tray 7 is then closed.

The robot 2 arrives to find the first preform 6 on the closed tray 7, first placing the suction plates 30 of its head 4 exactly above the masks 18 of the preform 6. The suction action is then activated (in this case it is a slight suction action since there is practically no leak thanks to the hermetic masks blocking the suction holes 31): the preform 6 is picked up sandwiched between the mask and the suction plate, and thus can be carried to any of the processing workstations, held in position continuously by the head 4 during the whole process. The robot movements are coordinated with those of the processing means 9 in order to present the pieces to these means 9 in a suitable way. If necessary, the robot 2 can impart sharp movements to the picked-up preform in order to provoke determined movements through inertia to the parts of the preform 6 not held by the suction action, in particular the marginal parts 25 outside the mask perimeters, facilitating presentation under the processing means 7. The preform 6, still held in position by the pick-up head 4 and the masks 18, then continues to the processing workstation 9. It slides without any difficulty and without soiling onto the work table 8 of the processing workstation 9 because of the masks 18 (chosen in a material with low friction level compared to the work surface material). Advantageously, all scraps (from cutting out operations for example) are immediately sucked up and evacuated from the workstation 9. The robot then replaces the processed preform on tray 7, and moves to the following preform.

The processed preforms are removed from tray 7 by an operator or another robot; the mask 18 is left in the indentation or, if it is used by the pick-up robot, another mask is placed in the. indentation of tray 7.

The processed preforms are then subjected to the following and final manufacturing stages, for example, thermoforming of the cups, and attachment of the shoulder straps, to complete the final product.

The invention claimed is:

1. A method for processing a textile piece, comprising:

placing the textile piece on a non-porous mask having a shape corresponding to at least a portion of the textile piece;

moving a pick-up head above the textile piece, said pick-up head having a shape corresponding to said shape of said non-porous mask;

moving said pick-up head to carry the textile piece and said non-porous mask to a processing area;

processing a processed portion of the textile piece while a non-processed portion of the textile piece is held between said non-porous mask and said pick-up head; and drawing suction through said pick-up head so that the textile piece is held between said non-porous mask and said pick-up head.

2. The method as in claim 1, further comprising moving said pick-up head to carry the textile piece and said non-porous mask to an arrival area.

3. The method as in claim 1, wherein said non-processed portion is an internal surface of the textile piece and said processed portion is a marginal surface surrounding at least a portion of said internal surface.

4. The method as in claim 1, wherein said processed portion comprises a central part of the textile piece.

5. The method as in claim 1, wherein said processing comprises cutting the textile piece.

6. A device for processing a porous textile piece, comprising:

a non-porous mask having a shape corresponding to at least a portion of the textile piece;

a pick-up head having a suction plate, said suction plate having a shape corresponding to said shape of said non-porous mask, wherein suction applied by said suction plate sandwiches the textile piece between said non-porous mask and said suction plate; and a processing area for processing the textile piece while the textile piece is sandwiched between said non-porous mask and said suction plate.

7. The device as in claim 6, further comprising a device for moving said pick-up head while the textile piece is sandwiched between said non-porous mask and said suction plate.

8. The device as in claim 7, wherein said device for moving said pick-up head comprises a multi-axis robot.

9. The device as in claim 6, further comprising a departure area for picking up the textile piece before processing at said processing area and an arrival area for placing the textile piece after processing at said processing area.

10. The device as in claim 6, wherein said suction plate comprises two separated parts.

* * * * *